United States Patent [19]

Filion

[11] 4,019,769

[45] Apr. 26, 1977

[54] SCREEN GRIPPER

[76] Inventor: Arnold J. Filion, Apt. 308 1397 Beacon St., Brookline, Mass. 02146

[22] Filed: Jan. 19, 1976

[21] Appl. No.: 650,529

[52] U.S. Cl. ..... 294/19 R; 294/1 R

[51] Int. Cl.[2] ..... A47F 13/06

[58] Field of Search ..... 294/1 R, 9, 10, 14, 294/19 R, 20–22, 49, 50, 55.5, 61, 86 R; 81/3 R; 210/238, 541, 542; 254/131

[56] References Cited

UNITED STATES PATENTS

| | | | |
|---|---|---|---|
| 1,468,878 | 9/1923 | Donald | 294/22 |
| 2,289,411 | 7/1942 | Denhard et al. | 210/541 X |
| 2,796,282 | 6/1957 | Petersen | 294/19 R |
| 3,433,521 | 3/1969 | Lasko | 294/19 R |

*Primary Examiner*—Johnny D. Cherry
*Attorney, Agent, or Firm*—Wolf, Greenfield & Sacks

[57] ABSTRACT

A hand-operated tool is used in removing and replacing grease screens. The tool has an elongated hand gripping portion carrying a spaced element gripping and moving end comprising first means for engaging and moving a screen to a release position to release a margin of the screen from a holding frame and having a second means for supporting a second portion of the screen to maintain the element in a predetermined plane and allow the element to be relocated in a desired area.

Grease screens and traps are often located above stoves and fried food cooking areas in restaurants and food service locations of all types. These screens or traps are normally planar elements which act to trap oil and grease particles as air is drawn through them to an exhaust system. The planar elements are often located at various angles to the vertical by conventional moldings which allow sliding of the screens in a plane to release one edge thereof followed by movement of the screen from that plane as by gravity so that the entire screen can be removed from its frame.

It is common for restaurant owners to use special screen cleaning services in order to remove screens for cleaning. Servicemen climb ladders to remove screens, replace the screens with clean screens and remove the screens to another premise for cleaning. Weekly service is not uncommon in restaurants of even relatively small volume. Such screen cleaning services exist and are used often because of the difficulties in removing and replacing the screens using ladders and conventional methods of handling.

7 Claims, 5 Drawing Figures

SCREEN GRIPPER

BACKGROUND OF THE INVENTION

It is an object of this invention to provide hand-operated tools for enabling rapid and easy removing and replacing of grease screens and grease trap elements located in releasable frames positioned at heights out of ordinary reach.

Still another object of this invention is to provide hand-operated tools in accordance with the preceding object which are adjustable to various conditions of mounting and various size screens.

Still another object of this invention is to provide a hand-operated tool in accordance with the preceding objects which is relatively inexpensive and can be easily manipulated by relatively unskilled persons without the need for complicated equipment or climbing devices.

According to the invention, a hand-operated tool for use in removing and replacing grease screens and trap elements has an elongated member with a hand gripping portion and an element gripping and moving end spaced from the hand gripping portion. The gripping and moving end comprises first means for engaging a first portion of the trap element and moving the trap element to a release position to release a margin of the trap from a supporting frame. A second means for supporting a second portion of the trap is provided to maintain the element in a predetermined plane and allow the element to be relocated in its desired area.

The means for engaging in one embodiment is a set of upstanding pin-like members where a screen element is to be engaged. In another embodiment, hook elements are used to engage handles on a screen or a trap element.

It is a feature of this invention that the tools can be made adjustable for screens and traps mounted at different angles to the vertical and mounted at different distances from the floor of a building.

BRIEF DESCRIPTION OF THE DRAWINGS

The above and other objects, features and advantages of the present invention will be better understood from the following description when read in conjunction with the accompanying drawings in which.

DESCRIPTION OF THE INVENTION

Figure 1:
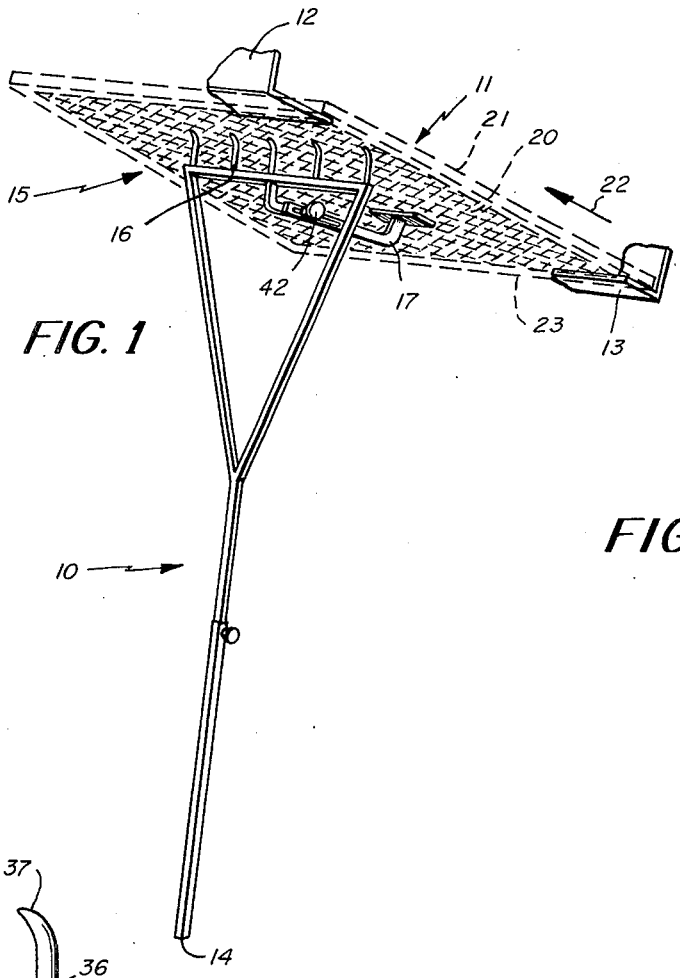
FIG. 1 is a perspective view of a tool in accordance with a preferred embodiment of this invention about to grip a conventional grease screen.
Figure 2:
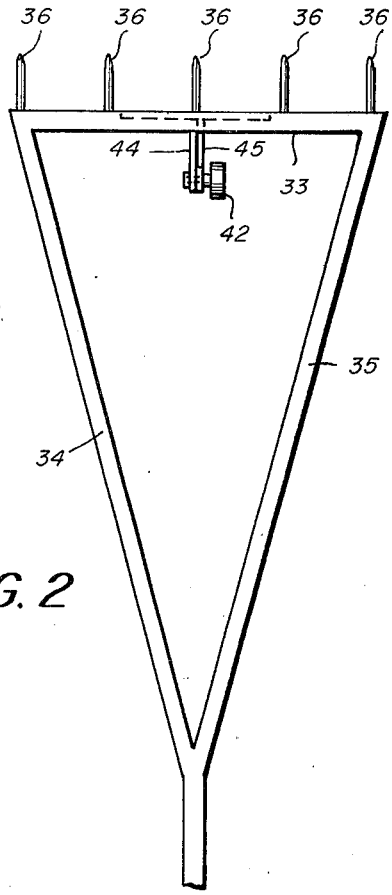
FIG. 2 is a front view of the element.
Figure 3:
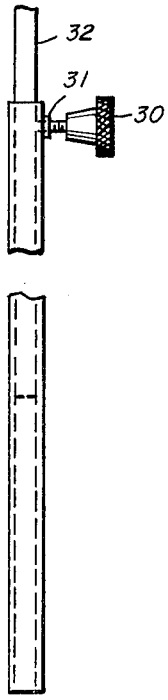
FIG. 3 is a side view of a portion thereof showing an element in an adjustable position.
Figure 3:
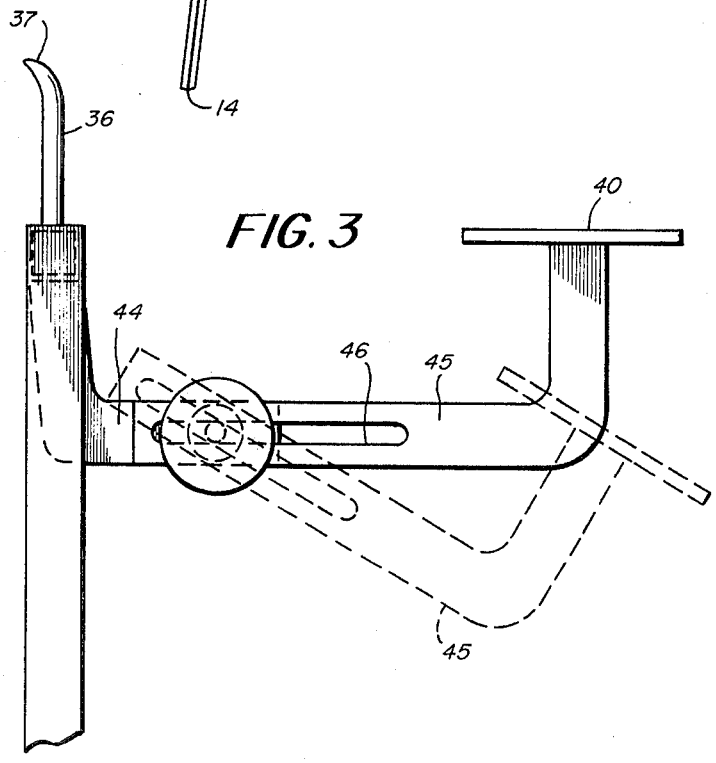

With reference now to the drawings and more particularly FIG. 1, a preferred embodiment of a hand-operated tool 10 is shown for use in removing and replacing screen elements such as 11 from positions out of reach of individuals standing on the floor of rooms and normally held in frame members such as 12 and 13. The tool has a hand gripping end 14 and an element gripping and moving end 15 spaced from the hand gripping end. The gripping and moving end has a first means 16 for engaging and moving a screen or trap element to a release position and a second menas 17 for supporting a second portion of the screen to maintain the element in a predetermined plane and allow the element to be relocated to a desired area.

The screen elements or trap elements can be of any conventional design as known for use above cooking areas in restaurants and the like. Ordinarily, filter screens for removing grease from air are positioned in front of ducts having exhaust fans drawing air from the room to an outside exhaust. The screens themselves are often as shown at 11 having a screen wire element 20 surrounded by a light aluminum frame 21 and may be for example 20 inches by 24 inches in dimension. The screens are held in place as in a ceiling by conventional molding strips 12 and 13 so that they can be slid in a direction such as 22 within the frame to release a lower edge 23 whereupon the lower edge will drop and the entire screen can be removed. Although a screen is shown in the drawing, in some cases, the exhaust ducts have their inlets covered with trap elements for trapping grease which elements are not filter screens. As used hereinafter the term "screens" is to mean and include grease filter mesh screens and traps of all types used in the applications described in this specification. The screens are normally from 10 × 16 to 25 × 16 inches in size although the size may vary greatly. In typical installations the screens are mounted on 7 or 8 foot high ceilings or between ceilings and walls. Often the screens may be located at angles of approximately 45° to the vertical and directly behind stoves. It is important to have a mechanism for sliding the screen elements in their own plane to release them from conventional molding holders while supporting the elements so that they do not then wildly swing prior to removal from their in place position.

The tool 10 at its handle end may be from 2 feet to 10 feet or more in length and is preferably adjustable so as to give versatility enabling use of the tool for different locations within the same restaurant. In the preferred embodiment, the tool is formed of a half inch square metal tube. The handle end 14 is fixed with a thumb wheel adjustment means 30 screwed into a threaded portion 31 of the handle end to allow a reduced cross sectional end of a Y-shaped portion 32 to axially slide within the handle end section 14. Tightening of the thumb screw 30 will enable adjustment in length of the handle. In some cases it may be desirable to provide stops or holes within the section 32 to receive the screw of the thumb screw 30 for more positive locating of the handle extension positions although this is not necessary.

At the element gripping and moving end of the tool, preferably a bar section 33 is mounted at its ends by Y extensions 34 and 35 with the bar section carrying upwardly extending prongs 36 which may be 5 in number as shown in the drawings although the number of prongs may vary.

The prongs 36 are each identical and extend upwardly from the bar 33. Hooked ends 37 enable a user to pass the prongs through the screen without damage to the screen. An extension portion 17 is supported by the bar 33 and carries a flat platform 40 for supporting a second portion of the tray spaced from the bar section 33. In the preferred embodiment the platform 40 is approximately 12 inches from sections 34 and 35 although it is adjustable over at least a 6 inch distance through the use of a thumb tightening screw 42. The screw 42 is threaded in an L-shaped extension piece 44 to which a flat angle piece 45 is held. Slot 46 enables the piece 45 to be adjusted angularly as well as axially of the length of the extension piece. The piece is positioned and the thumb screw 42 tightened to lock it in place. Thus, depending upon where the user will stand below the screen and the angle of the screen from the vertical, the user may wish to make an angular adjustment to the extension piece.

In use, the adjustable mechanisms are locked to provide fixed positions for the extension piece and the handle. The user normally uses two hands on the hand gripping portion, raises the tool to engage the prongs with the screen element and moves the screen element as in the direction of arrow 22, with the portion 40 engaging the lower portion of the screen. The lower edge 23 is exposed, drops slightly and the screen can then be moved downwardly from its position within the frame and is then readily available for cleaning. Repositioning is accomplished by reversal of the above steps.

Figures 4, 5:
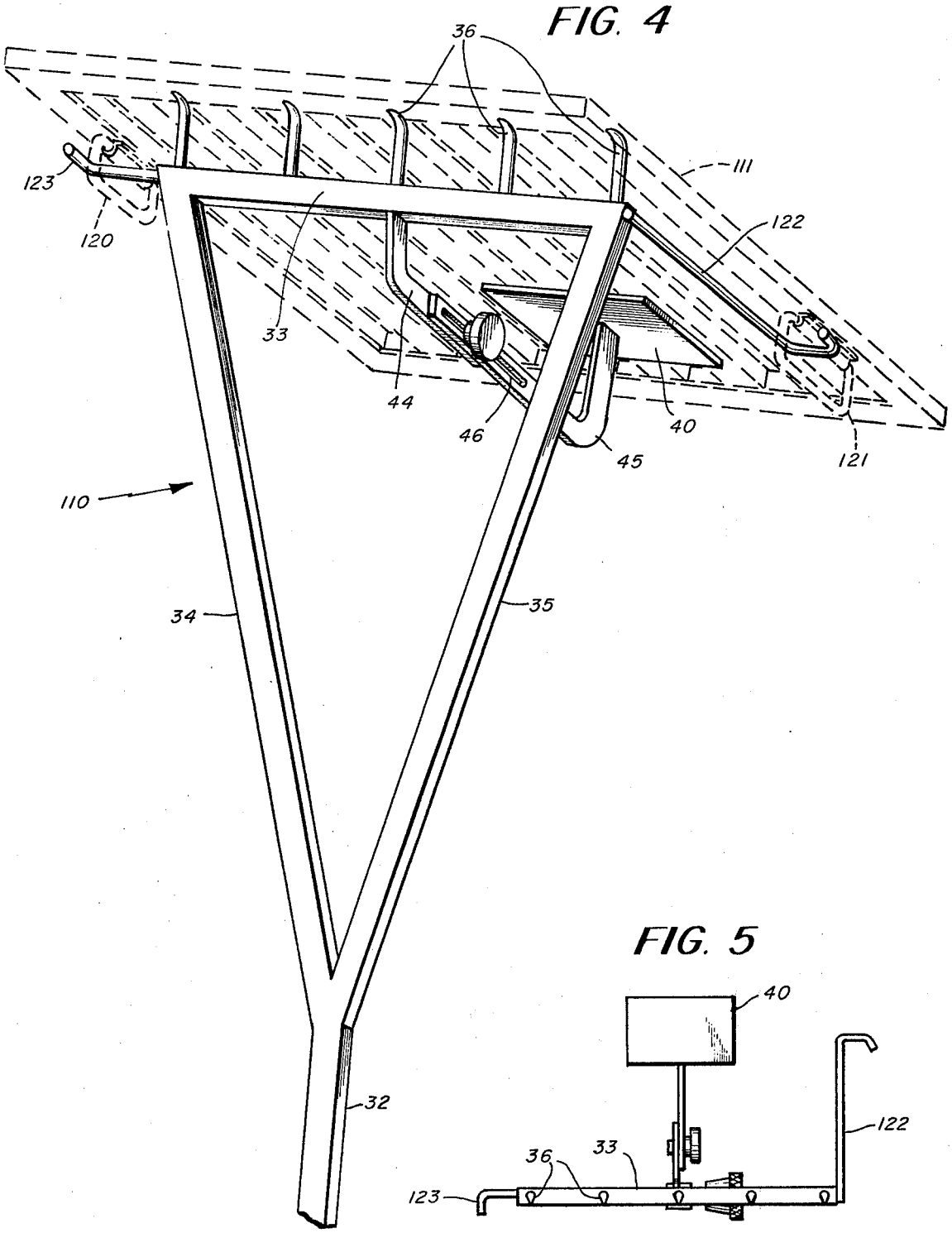
FIG. 4 is a perspective view of an alternate embodiment thereof.
FIG. 5 is a top view of the embodiment of FIG. 4.

FIGS. 4 and 5 illustrate an alternate embodiment of the invention useful to remove grease screens or traps which have handles such as opposed D-shaped handles 120 and 121. The device 110 is identical to device 10 except for two additional J-shaped hook members 123 and 122 positioned to mate with handles 120 and 121 respectively. All other portions of the device illustrated are numbered as in corresponding members in the first embodiment.

The tool 110 can easily be manipulated by hand to engage and disengage the handles 120, 121 for removal and replacement. The members 122 and 123 are preferably welded onto the handle portion although they can be mounted in any convenient way.

The tool 110 can be used as in the embodiment of FIG. 1 or to positively hold handles. In some cases, the prongs 36 can be eliminated and only the hooks 122 and 123 used as where the screens or traps of interest all have handles.

The particular shape of the hooks can vary greatly to mate with handles on the screens as might be necessary for any particular use.

While a specific embodiment of this invention has been shown and described, many modifications are possible. For example, the shape of the handle can vary as can the materials. In all cases, a first section is used which enables shifting of the screen substantially in a plane followed by support of the screen enabling removal. The grease trap elements can be filter screens or traps of many varieties as known for use with exhaust fan means from cooking areas. In some cases, the adjustment mechanisms described above are eliminated and a non-adjustable tool set at most commonly used angles and lengths is used. The handle and frames can have various shapes and be formed of various materials as desired.

I claim:

1. A hand-operated tool for use in removing and replacing grease screen and trap elements positioned at elevated locations in frame means for holding said elements in operative position, said tool comprising, an elongated member having a hand gripping portion and carrying an element gripping and moving end spaced from said hand gripping portion, said gripping and moving end comprising first means for engaging a first portion of said element and moving said element to a release position to release a margin of said element from said frame means, and second means for supporting a second portion of said element by underlying said second portion to maintain said element in a predetermined plane and allow said element to be relocated to a desired area.

2. A hand-operated tool in accordance with claim 1 and further comprising said first means being in the form of upwardly extending prongs.

3. A hand-operated tool in accordance with claim 1 and further comprising said first means comprising opposed hook shaped means for engaging said element, with said element comprising opposed hook receiving handles.

4. A hand-operated tool in accordance with claim 1 and further comprising said hand gripping portion being adjustable to vary its axial length.

5. A hand-operated tool in accordance with claim 4 and further comprising said second means for supporting a second portion of said element being adjustable to provide for selective variation as to angular engagement with said element and varying sizes of said element.

6. A method of removing a grease screen and trap element from a holding means, said method comprising using an elongated tool to grasp said element and move it in a first direction, said tool including an element support means for underlying and supporting said element after said movement, and supporting said element while enabling lowering of said element.

7. A method in accordance with the method of claim 6 wherein said element is a substantially planar element and is moved substantially in its plane in said first direction, said support means being positioned to underlie and support said element after said movement whereby said element may be removed from its said plane to an underlying position.

* * * * *